United States Patent [19]

Nakamura et al.

[11] 4,344,503

[45] Aug. 17, 1982

[54] DIAPHRAGM FOR ELECTRO-ACOUSTIC TRANSDUCER

[75] Inventors: Akira Nakamura, Shizuoka; Takao Nakaya, Hamamatsu, both of Japan

[73] Assignee: Nippon Gakki Seizo Kabushiki Kaisha, Hamamatsu, Japan

[21] Appl. No.: 227,713

[22] Filed: Jan. 23, 1981

[30] Foreign Application Priority Data

Feb. 1, 1980 [JP] Japan ..... 55-9994
Feb. 1, 1980 [JP] Japan ..... 55-9995

[51] Int. Cl.[3] ..... H04R 7/00
[52] U.S. Cl. ..... 181/170; 181/168
[58] Field of Search ..... 181/166–170, 181/294; 428/116

[56] References Cited

U.S. PATENT DOCUMENTS 4,135,601 1/1979 Tsukagoski et al. ..... 181/167

FOREIGN PATENT DOCUMENTS 54-147828 11/1979 Japan ..... 181/167
55-41042 3/1980 Japan ..... 181/170
55-15153 4/1980 Japan ..... 181/167
55-33238 8/1980 Japan ..... 181/167

*Primary Examiner*—Benjamin R. Fuller
*Attorney, Agent, or Firm*—Spensley, Horn, Jubas & Lubitz

[57] ABSTRACT

A diaphragm for electro-acoustic transducer which, as a component member, utilizes a layer of ceramics material, by which the $E/\rho$ ratio of the diaphragm can be increased, leading to an elevated resonance frequency of the diaphragm, whereby the limit frequency for reproducting of high-pitch sound can be shifted high, thus making it possible to widen the range of piston motion of the diaphragm, and to thereby improve its frequency characteristic. Also, a diaphragm utilizing a composite board formed by lamination of a layer of ceramics material and a layer of light-weight metal eliminates the fragility of diaphragm would entail when the diaphragm utilizes a single layer of a ceramics material alone, and thus the handling of the diaphragm is facilitated.

17 Claims, 6 Drawing Figures

DIAPHRAGM FOR ELECTRO-ACOUSTIC TRANSDUCER

BACKGROUND OF THE INVENTION (a) Field of the Invention:

The present invention relates to a diaphragm for use in elecro-acoustic transducers such as loudspeakers, headphones, microphones and the like, and more particularly it pertains to a diaphragm utilizing ceramics material as a component of such diaphragm.

(b) Description of the Prior Art:

Diaphragms for use in electro-acoustic transducers such as loudspeaker and comprising a core member with a honeycomb structure are well known. Typically such diaphragm is constructed with a planar-shape honeycomb core member having a skin member adhering to both surfaces of this core member. Known diaphragms of this type use, as a skin member, such material as aluminum, duralumin, glass fiber-reinforced plastics (GFRP), carbon fiber-reinforced plastics (CFRP) and aromatic polyamide fiber-reinforced plastics (for example, a product of Dupont in U.S.A. sold under the tradename of KEVLAR FRP). A skin member made with such material as described above is available at a relatively low price, but it has the drawback that the $E/\rho$ ratio between Young's modulus E and density $\rho$ is small. In general, a diaphragm for electro-acoustic transducer is such that the greater the $E/\rho$ ratio is, the higher will become its resonance frequency, resulting in a widened range of piston motion which is the frequency range of such vibration as will not produce partial vibration of diaphragm, so that the higher will its limit frequency for the reproduction of high-pitch sound, thereby the frequency characteristic of the diaphragm is improved. However, known diaphragms having a honeycomb structure has a small $E/\rho$ ratio of its skin member, so that they have the drawback that good sound reproduction characteristic cannot be obtained. In case beryllium is used as the material of a skin member, the $E/\rho$ ratio can be raised. However, because beryllium per se is expensive, there is the problem that a diaphragm using beryllium becomes accordingly high in the cost of manufacture.

By the way, a diaphragm made with a single ceramics material so as to obtain a large $E/\rho$ ratio and low cost is known. But, such diaphragms are inferior in fragility characteristics. In general, a diaphragm for electro-acoustic transducer with a small thickness and a light weight is preferable because of its superior reproducing characteristic. However, such diaphragms are fragile, so that they must be carefully handled.

SUMMARY OF THE INVENTION

It is, therefore, a primary object of the present invention to provide a diaphragm for electro-acoustic transducer which can have a large $E/\rho$ ratio by the use of ceramics as its constituting material.

Another object of the present invention is to provide a diaphragm of the type as described above, which, due to elevated $E/\rho$ ratio, has a high resonance frequency and a resulting widened range of piston motion and an improved frequency characteristic.

Still another object of the present invention is to provide a diaphragm of the type as described above, which is made with a composite board member formed with a layer of a ceramics material and a light-weight metal layer to thereby overcome the fragility which would be presented when a layer of ceramics alone is used to constitute the skin member, and to thereby facilitate its handling.

A further object of the present invention is to provide a diaphragm of the type as described above, which has a honeycomb structure provided, on at least one side thereof, with a skin member formed with laminated board member made of a layer of a ceramics material and a layer of a light-weight metal.

A still further object of the present invention is to provide a diaphragm which is formed with a laminated board member of the type described above and having a dome-like or cone-shaped configuration.

Figure 1:
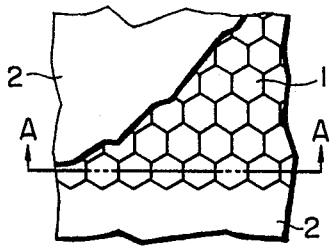
FIG. 1 is a diagrammatic fragmentary plan view, partly broken away, of a skin member provided on the upper surface of the planar diaphragm having a honeycomb structure, representing an embodiment of the present invention.

Next, the property of ceramics materials made of various kinds of oxides is shown in Table 1. For the purpose of reference, the property of the conventional skin member is shown also. It should be noted that titania ($TiO_2$) does not have a remarkably large $E/\rho$ ratio as compared with a conventional skin member, but it is low in price, so that it has an advantage with respect to cost of manufacture.

TABLE 1

| | E (GN/m²) | ρ Kg/m³) | E/ρ (m/sec)² |
|---|---|---|---|
| Oxides of ceramics | | | |
| Beryllia (BeO) | 356.97 | $3.03 \times 10^3$ | $117.81 \times 10^6$ |
| Magnesia (MgO) | 295.19 | $3.65 \times 10^3$ | $80.87 \times 10^6$ |
| Alumina ($Al_2O_3$) | 380.51 | $3.97 \times 10^3$ | $95.85 \times 10^6$ |
| Silicon dioxide ($SiO_2$) | 111.00 | $2.65 \times 10^3$ | $41.89 \times 10^6$ |
| Titania ($TiO_2$) | 88.26 | $4.10 \times 10^3$ | $21.53 \times 10^6$ |
| Conventional skin member made of | | | |
| Aluminum | 62.00 | $2.70 \times 10^3$ | $23.00 \times 10^6$ |
| Duralumin | 74.00 | $2.70 \times 10^3$ | $27.40 \times 10^6$ |
| CFRP | 15.00 | $1.30 \times 10^3$ | $11.50 \times 10^6$ |
| GFRP | 6.50 | $1.49 \times 10^3$ | $4.40 \times 10^6$ |
| Beryllium | 308.80 | $1.85 \times 10^3$ | $166.50 \times 10^6$ |

Though not mentioned in Table 1 , ceramics can include, other than oxides, metal carbides such as titanium carbide (TiC), zirconium carbide (ZrC), boron carbide ($B_4C$) and tungsten carbide (WC), metal borides such as chronium boride (CrB) and zirconium boride ($ZrB_2$), and metal nitrides such as born nitride (BN), aluminum nitride (AlN), magnesium nitride ($Mg_3N_2$) and titanium nitride (TiN), which are made by said PVD method.

It should be understood here that the E/ρ ratio of the skin member does not directly represent the E/ρ ratio of the diaphragm as a whole. Therefore, the dynamics of this diaphragm having a sandwich structure will be explained briefly hereunder.

In general, the flexural rigidity D of a sandwich structure is known to be expressed by the following formula:

$$D = \frac{E_s}{12(1-\nu_s^2)}\left\{ t^3 - \alpha t_c^3 - \frac{3\alpha t_c(t_{s1}-t_{s2})^2}{1-\alpha\frac{t_c}{t}} \right\}, \quad (1)$$

$$\text{wherein: } \alpha = 1 - \frac{E_c(1-\nu_s^2)}{E_s(1-\nu_c^2)},\ t = t_c + t_{s1} + t_{s2},$$

also, $t_c$ represents the thickness of the honeycomb core; $t_{s1}$, $t_{s2}$ represent the thicknesses of the front and rear skin members; $E_c$ represents the Young's modulus of the honeycomb core; $E_s$ represents the Young's modulus of the skin member; $\nu_c$ represents the Poisson's ratio of the honeycomb core; and $\nu_s$ represents the Poisson's ratio of the skin member.

By forming the thicknesses $t_{s1}$ and $t_{s2}$ of the front and rear skin members equal to each other, the parenthesized third term in Formula (1) will become zero (0). Also, in general, $E_s >> E_c \approx 0$. Accordingly, $\alpha \approx 1$. Therefore, Formula (1) will become as follows:

$$D = \frac{E_s}{12(1-\nu_s^2)}(t^3 - t_c^3). \quad (2)$$

Here, if $\nu_s < 0.3$, the following approximate formula will be established:

$$D \approx \frac{E_s}{12}(t^3 - t_c^3). \quad (3)$$

If the dimensions of the diaphragm are set, t and $t_c$ will become substantially constant values from the relationship $t >> t_c$. Therefore, t and $t_c$ may be used as constants. Thus, the flexural rigidity D of the diaphragm will depend substantially on Young's modulus $E_s$ of the skin member.

Here, the relationship between the flexural ridigity D of the diaphragm and the resonance frequency $f_r$ of the diaphragm is as shown by the following formula:

$$f_r \propto \sqrt{\frac{D}{\sigma}}, \quad (4)$$

wherein: $\sigma$ represents the surface density of the diaphragm. Accordingly, $f_r$ and $E_s$ are in a proportional relationship. If the skin member is made with a ceramics material having a large Young's modulus, the diaphragm will have a high resonance frequency. Thus, the piston motion range of the actuated diaphragm will become widened, so that the limit frequency for the reproduction of high-pitch sound is shifted upward, resulting in a lowered distortion factor and an improved frequency characteristic and also in a reduced transient distortion.

As stated above, in case a ceramic material is used to form a skin member, the range of piston motion is widened, and accordingly a good frequency characteristic can be realized. In addition, there is the advantage that this realization can be attained at a low cost.

However, a ceramics material, on the other hand, has the property of being fragile. Accordingly, in spite of the advantage that a layer of ceramics material having a smaller thickness and a lighter weight can display a more desirable frequency characteristic, there arises a difficulty in its handling due to its increased fragility.

Figure 3:
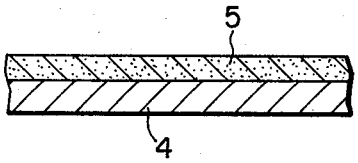
FIG. 3 is a diagrammatic sectional view of a laminated board formed with a light-weight metal foil and a layer of ceramics.

Another embodiment shown in FIG. 3 represents an instance wherein the above-said consideration is taken into account. That is, a composite or laminated board which is formed by laminating a layer 5 of ceramics, by relying on the PVD method, on a light-weight metal foil 4 serving as the base, is used as a component of a diaphragm.

Here, let us assume that Young's modulus of the light-weight metal foil 4 is designated as $E_1$, the secondary moment of the section thereof as $I_1$, the thickness thereof as $t_1$, Young's modulus of the layer 5 of ceramics as $E_2$, the secondary moment of the section thereof as $I_2$, the thickness thereof as $t_2$, Young's modulus of the composite board as E and the secondary moment of the section thereof as I. Then, the following formula relating to flexural rigidity, in general, can be established as follows:

$$EI = E_1I_1 + E_2I_2 \quad (5).$$

If $t_1 = t_2$, then $I_1 = I_2 = \frac{1}{2}I$, and Formula (1) will become as follows:

$$E = E_1/2 + E_2/2 \quad (6).$$

Young's modulus E of the composite board thus prepared can be obtained from the above formula.

Here, let us use a light-weight metal foil 4 made of an aluminum alloy such as 2.5Mg-0.25Cr-97.25Al or 5.2Mg-0.1Cr-0.1Mn-94.6Al. Also, a layer 5 of ceramics made of alumina is used. Both the light-weight metal foil 4 and the ceramics layer 5 are prepared to have a same thickness of 25 μm. With these constituent members, a composite board is prepared. Young's modulus E of the composite board will be 225.5 ($GN/m^2$), and the density $\rho$ will be $3.34\times10^3$ ($kg/m^3$). Accordingly, $E/\rho$ will become $67.5\times10^6[(m/sec)^2]$. If the board is composed of only an aluminum alloy board having a thickness of 50 $\mu$m, Young's modulus of such board will be 70.5($GN/m^2$), and the density $\rho$ will be $2.7\times10^3(kg/m^3)$. Thus, $E/\rho$ will become $26.1\times10^6[(m/sec)^2]$. Accordingly, the composite board in this embodiment will have an $E/\rho$ ratio which is about 2.6 times as great as that of the single light-weight metal foil.

As a light-weight metal foil, there can be used, in addition to aluminum or aluminum alloy mentioned above, beryllium, boron, magnesium, titanium and their alloys. A light-weight metal is defined, in general, as a metal having a relatively light weight, whose specific gravity is 5.0 or smaller. Also, as a ceramics material, there can be used, other than alumina, metal oxides such as berylia (BeO), magnesia (MgO), silicon dioxide ($SiO_2$) and titania ($TiO_2$), which are made by relying on said PVD method. These light-weight metals and ceramics may be combined together in any arbitrary proportion so as to meet a required property. In Table 2 are shown some of the physical properties of the boards of typical combinations having a thickness of 50 $\mu$m, as well as of light-weight metal and ceramics having an equal thickness (25 $\mu$m–25 $\mu$m).

TABLE 2

| | E ($GN/m^2$) | $\rho$ ($Kg/m^3$) | $E/\rho$ $(m/sec)^2$ |
|---|---|---|---|
| Composite board | | | |
| Beryllia-Aluminum | 213.74 | $2.87\times10^3$ | $74.47\times10^6$ |
| Magnesia-Aluminum | 182.85 | $3.175\times10^3$ | $57.59\times10^6$ |
| Alumina-Aluminum | 225.51 | $3.34\times10^3$ | $67.50\times10^6$ |
| Silicon Dioxide-Aluminum | 90.75 | $2.68\times10^3$ | $33.86\times10^6$ |
| Titania-Aluminum | 79.38 | $3.40\times10^3$ | $23.34\times10^6$ |
| Beryllia-Beryllium | 332.89 | $2.44\times10^3$ | $136.40\times10^6$ |
| Magnesia-Magnesium | 181.00 | $2.70\times10^3$ | $67.03\times10^6$ |
| Titania-Titanium | 103.63 | $4.32\times10^3$ | $23.99\times10^6$ |
| Light-weight metal foil | | | |
| Beryllium | 308.80 | $1.85\times10^3$ | $166.50\times10^6$ |
| Boron | 450.00 | $2.46\times10^3$ | $182.92\times10^6$ |
| Magnesium | 46.00 | $1.74\times10^3$ | $26.50\times10^6$ |
| Aluminum | 62.00 | $2.70\times10^3$ | $23.00\times10^6$ |
| Titanium | 119.00 | $4.54\times10^3$ | $26.20\times10^6$ |
| Oxide ceramics | | | |
| Beryllia (BeO) | 356.97 | $3.03\times10^3$ | $117.81\times10^6$ |
| Magnesia (MgO) | 295.19 | $3.65\times10^3$ | $80.87\times10^6$ |
| Alumina ($Al_2O_3$) | 380.51 | $3.97\times10^3$ | $95.85\times10^6$ |
| Silicon dioxide ($SiO_2$) | 111.00 | $2.65\times10^3$ | $41.89\times10^6$ |
| Titania ($TiO_2$) | 88.26 | $4.10\times10^3$ | $21.53\times10^6$ |

For example, composite boards such as Beryllia-Aluminum, Magnesia-Aluminum, Alumina-Aluminum and Magnesia-Magnesium have an $E/\rho$ ratio of about $60–70\times10^6$ $[(m/sec)^2]$. Thus, these composite boards have an $E/\rho$ ratio of 2 to 3 times as great as that of a single metal such as aluminum, magnesium and titanium which has an $E/\rho$ ratio $23–26\times10^6[(m/sec)^2]$. Also, a composite board made of beryllia-beryllium has an $E/\rho$ ratio of more than 5 times as great as that of a single metal such as aluminum, magnesium and titanium.

Though not mentioned in Table 2, as ceramics other than oxides, there can be used metal carbides such as titanium carbide (TiC), zirconium carbide (ZrC), boron carbide ($B_4C$) and tungsten carbide (WC), metal borides such as chromium boride (CrB) and zirconium ($ZrB_2$), and metal nitrides such as boron nitride (BN), aluminum nitride (AlN), magnesium nitride ($Mg_3N_2$) and titanium nitride (TiN).

Figure 4:
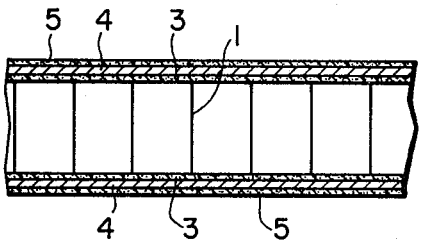
FIG. 4 is a diagrammatic sectional view of a planar-type diaphragm having a honeycomb structure using said laminated board as a skin member.

FIG. 4 shows a planar type diaphragm which is formed by using a honeycomb core 1 formed with an aluminum foil, the front and the rear sides of which are bonded, by a bonding agent 3, with skin members, respectively, which are each made of the above-mentioned composite board. In this instance, the bonding of the composite board to the honeycomb core 1 is done in such a way that the ceramics layer 5 will be exposed on each outside of the diaphragm to provide a sound-radiating face. It should be understood, however, that contrarily the light-weight metal foil 4 may form the exposed side.

Figure 2:
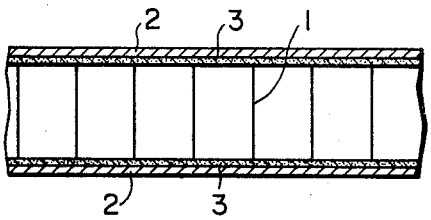
FIG. 2 is a diagrammatic sectional view taken along the line A—A in FIG. 1.
Figure 5:
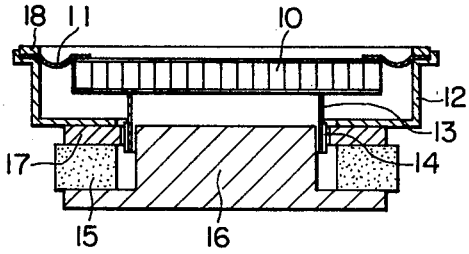
FIG. 5 is a diagrammatic sectional view of a planar-type speaker using the diaphragm shown in FIG. 2 or FIG. 3.

FIG. 5 is a sectional view of a speaker using the planar-type diaphragm shown in FIG. 2 or FIG. 4. The diaphragm is indicated at 10. Numeral 11 represents a suspension member for attaching the marginal portion of the diaphragm 10 to a frame 12. 13 represents a voice coil bobbin secured to a rear side of the diaphragm, 14 a voice coil wound around the voice coil bobbin 13, 15 a magnet, 16 a pole piece, 17 a yoke plate, and 18 a gasket for nipping the marginal end of the suspension member 11. The voice coil 14 is disposed within an air gap formed between the pole piece 16 and the yoke plate 17. When a signal current is caused to flow through this voice coil 14, the diaphragm 10 will vibrate in accordance with the polarity and the magnitude of the signal current, due to electro-magnetic action caused by this current with the magnetic field formed within the air gap. In this instance, the diaphragm 10 as a whole has a large $E/\rho$ ratio, so that the range of piston motion is widened.

Figure 6:
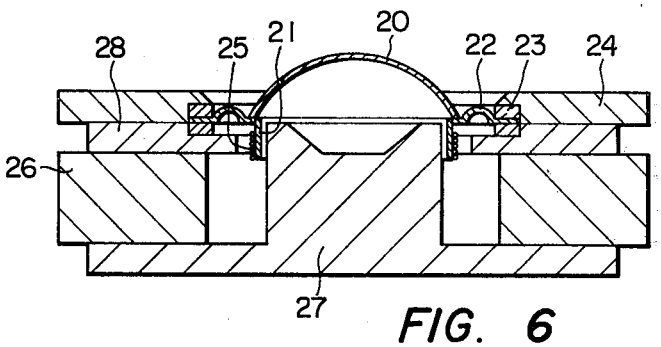
FIG. 6 is a diagrammatic sectional view of a speaker having a diaphragm having a dome-like configuration and using laminated board of FIG. 3. cl DETAILED DESCRIPTION OF THE PREFERRED EMBODIMENTS In FIGS. 1 and 2, reference numeral 1 represents a honeycomb core made with an aluminum foil and formed in the shape of a planar board which is parallel with a cross sectional direction in FIG. 2. Numeral 2 represents a skin member made with a thin layer of ceramics applied to each surface of the honeycomb core 1 in this embodiment by a bonding agent or a bonding film 3. A suitable ceramic material for constituting the skin member 2 is a metal oxide such as berrylia (BeO), alumina ($Al_2O_3$), magnesia (MgO), silicon dioxide ($SiO_2$) and titania ($TiO_2$). Such ceramic material is caused to deposit or grow on a copper base by relying on the so-called PVD (Physical Vapor Deposition) process such as plasma jet bonding, ion-plating and vacuum-evaporation-deposition, thereafter removing same by resolving the copper base by etching with nitric acid to form a board having a thickness of 20 $\mu$m–75 $\mu$m. The skin member 2 made with such ceramics has an $E/\rho$ ratio smaller than that of beryllium, but greater than that of aluminum, duralumin, GFRP and CFRP. In addition, the price of the skin member made with a ceramics material is much cheaper than that made with beryllium, so that ceramics is very suitable as a material of the skin member which is employed in a diaphragm having a honeycomb structure.

FIG. 6 shows a sectional view of a speaker such as tweeter and squawker using a diaphragm 20 prepared by the above-said composite board into a dome-like configuration. In this embodiment also, the sound-radiation side is usually covered by a ceramics layer. However, the light-weight metal foil may be used on the sound-radiation side. In this instance, the diaphragm 20 is manufactured by forming a dome-like configuration from a light-weight metal layer by deep drawing, and thereafter ceramics layer is deposited by relying on the PVD method. In FIG. 6, numeral 21 represents a cylindrical-shaped voice coil bobbin secured to the marginal portion of the diaphragm 20, 22 a suspension member disposed at the marginal portion of the diaphragm, 23 a guide ring for nipping the external peripheral portion of the suspension member 22, 24 a frame for holding the guide ring 23, 25 a voice coil wound around the voice coil bobbin 21, 26 a magnet, 27 a pole piece, and 28 a yoke plate. The voice coil 25 is disposed within an air gap formed between the pole piece 27 and the yoke plate 28. When a sound signal current is caused to flow through the voice coil 25, the diaphragm 20 will vibrate in its axial direction.

This dome-like diaphragm 20, if made with a single ceramics layer alone, will become fragile and easy to break. However, if the diaphragm 20 is made with a composite board, the diaphragm as a whole will have a reduced fragility, and will become very easy to handle. Accordingly, the resulting diaphragm will have an elevated resonance frequency, so that there is obtained a speaker having a superior frequency characteristic.

In the embodiment shown in FIG. 6, a composite board is used to form a diaphragm. It should be understood that it is possible to apply this composite board to serve as a center cap for a cone-shaped speaker for shutting-out dust.

What is claimed is:

1. A diaphragm for an electro-acoustic transducer, comprising:

a core member; and a skin member disposed to at least one side of said core member and being made with a layer of ceramics material which covers substantially the entire surface of the core member, wherein said ceramics material is a metal oxide selected from the group consisting of berrylia (BeO), alumina ($Al_2O_3$), magnesia (MgO), silicon dioxide ($SiO_2$) and titania (TiO).

2. A diaphragm for an electro-acoustic transducer, comprising a composite board formed by a lamination of a layer of light-weight metal and a layer of ceramics material, wherein the layer of ceramics material covers substantially the entire surface of the layer of metal and wherein said ceramics material is a metal oxide selected from the group consisting of berrylia (BeO), alumina ($Al_2O_3$), magnesia (MgO), silicon dioxide ($SiO_2$) and titania (TiO).

3. A diaphragm for an electro-acoustic transducer, comprising:

a core member having a honeycomb structure; and a skin member disposed to at least one side of said core member and being made with a composite board formed by a lamination of a layer of light-weight metal and a layer of a ceramics material, wherein the layer of ceramics material covers substantially the entire surface of the layer of metal and wherein said ceramics material is a metal oxide selected from the group consisting of berrylia (BeO), alumina ($Al_2O_3$), magnesia (MgO), silicon dioxide ($SiO_2$) and titania (TiO).

4. A diaphragm according to claim 3, in which said honeycomb core is formed with an aluminum foil.

5. A diaphragm for an electro-acoustic transducer, comprising:

a core member; and a skin member disposed to at least one side of said core member and being made with a layer of a single ceramics material which covers substantially the entire surface of the core member, wherein said ceramics material is a metal boride selected from the group consisting of chromium boride (CrB) and zirconium boride ($ZrB_2$).

6. A diaphragm according to claims 1 or 5, in which said core member has a honeycomb structure.

7. A diaphragm according to claim 6, in which said honeycomb core is formed with an aluminum foil.

8. A diaphragm according to claims 1 or 5, in which said skin member made with a layer of a single ceramic material is one formed by depositing a ceramics material on a base by relying on a PVD method, and thereafter by removing said base.

9. A diaphragm for electro-acoustic transducer, comprising a composite board formed by a lamination of a layer of light-weight metal and a layer of ceramic material, wherein the layer of ceramics material covers substantially the entire surface of the layer of metal and wherein said ceramics material is a metal boride selected from the group consisting of chromium boride (CrB) and zirconium boride ($ZrB_2$).

10. A diaphragm according to claims 2 or 9, wherein said composite board has a dome-like configuration.

11. A diaphragm according to claims 2 or 9, wherein said composite board has a cone-shaped configuration.

12. A diaphragm according to claims 1 or 9, in which said layer of ceramics of material has a thickness of 20 μm–75 μm.

13. A diaphragm for electro-acoustic transducer, comprising:

a core member having a honeycomb structure; and a skin member disposed to at least one side of said core member and being made with a composite board formed by a lamination of a layer of a light-weight metal and a layer of a ceramics material wherein the layer of ceramics material covers substantially the entire surface of the layer of metal and wherein said ceramics material is a metal boride selected from the group consisting of chromium boride (CrB) and zirconium boride ($ZrB_2$).

14. A diaphragm according to claims 2, 3, 9 or 13, wherein said composite board is one formed by depositing a ceramics material on a light-weight metal by relying on a PVD method.

15. A diaphragm according to claims 2, 3, 9 or 13, wherein said light-weight metal is one selected from the group consisting of aluminum, beryllium, magnesium, titanium, boron and their alloys.

16. A diaphragm according to claims 2, 3, 9 or 13, in which said light-weight metal has a specific gravity of 5.0 or smaller.

17. A diaphragm according to claims 2, 3, 9 or 13, in which said composite board has a thickness of 50 μm, and in which said layer of light-weight metal and said layer of ceramics material each has a thickness of 25 μm.

* * * * *